US005541053A

United States Patent [19]

Martin

[11] Patent Number: 5,541,053

[45] Date of Patent: Jul. 30, 1996

[54] PROCESS FOR THE PREPARATION OF SILVER HALIDE PHOTOGRAPHIC EMULSIONS CONTAINING GRAINS HAVING (100) FACES WITH CAVITIES AND PHOTOGRAPHIC EMULSIONS SO PREPARED

[75] Inventor: Didier J. Martin, Givry, France

[73] Assignee: Eastman Kodak Company, Rochester, N.Y.

[21] Appl. No.: 465,035

[22] Filed: Jun. 5, 1995

Related U.S. Application Data

[63] Continuation-in-part of Ser. No. 290,647, Aug. 15, 1994, abandoned.

[30] Foreign Application Priority Data

Oct. 20, 1993 [FR] France ..... 93 12713

[51] Int. Cl.[6] ..... G03C 1/015; G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| 4,710,455 | 12/1987 | Iguchi et al. | 430/567 |
| 4,735,894 | 4/1988 | Ogawa | 430/569 |
| 4,769,315 | 9/1988 | Suda et al. | 430/567 |
| 5,045,443 | 9/1991 | Urabe | 430/567 |

FOREIGN PATENT DOCUMENTS

| | | | |
|---|---|---|---|
| 0462581A1 | 12/1991 | European Pat. Off. | G03C 1/035 |
| 0523464A1 | 1/1993 | European Pat. Off. . | |
| 60-136735 | 7/1985 | Japan . | |
| 60-221320 | 11/1985 | Japan . | |
| 83/02173A1 | 6/1983 | WIPO | G03C 1/02 |

*Primary Examiner*—Janet C. Baxter
*Attorney, Agent, or Firm*—Carl O. Thomas

[57] ABSTRACT

The present invention concerns a process for obtaining silver halide photographic emulsions containing grains of the core/shell type having {100} faces with cavities, and the corresponding photographic emulsions.

These emulsions present an improved sensitivity.

13 Claims, 3 Drawing Sheets

PROCESS FOR THE PREPARATION OF SILVER HALIDE PHOTOGRAPHIC EMULSIONS CONTAINING GRAINS HAVING (100) FACES WITH CAVITIES AND PHOTOGRAPHIC EMULSIONS SO PREPARED

This is a continuation-in-part of U.S. Ser. No. 8/290,647, filed Aug. 15, 1994, now abandoned.

FIELD OF THE INVENTION

The present invention concerns a process for obtaining silver halide photographic emulsions containing grains of the core/shell type having {100} faces with cavities, and the corresponding photographic emulsions.

BACKGROUND

Photographic imaging employing silver halide grains comprises a stage of forming a latent image. At the time of exposure, conduction band electrons are produced and these electrons migrate in the grain and are trapped at specific sites where the latent image is formed. In ordinary, non-sensitized, silver halide grains, dispersion of the sites promotes a faster subsequent development but enables only low sensitivity levels to be achieved. The purpose of the sensitization is to concentrate these sites in order to increase sensitivity. However, in doing this, the development speed is reduced.

Means have therefore been sought for improving the concentration and localization of the latent image sites in silver halide grains. These means in the prior art include using compounds which are adsorbed selectively on certain sites in the grains, introducing distortions in the grain or in the crystalline morphology of the grains, as described in European patent 96 726 or U.S. Pat. No. 5,045,443, modifying the grains by epitaxy, as described in European patent 462,581, or again producing grains with a complex crystalline form, as described in U.S. Pat. No. 4,710,455. None of these different means is entirely satisfactory.

SUMMARY OF THE INVENTION

The present invention relates to a process for obtaining a silver halide emulsion with an improved sensitivity due to a better concentration of the latent image sites, resulting from the particular morphology of these grains.

In one aspect this invention is directed to a process for preparing silver halide emulsions containing silver halide grains having {100} crystal faces comprised of a silver bromide or bromoiodide core and a silver bromochloride shell surrounding the core wherein the shell presents at least one {100} crystal face laterally surrounding a concave surface, also called "cavity", and from 10 to 90 percent of the projected area of the concave surface and the laterally surrounding {100} crystal face being accounted for by the concave surface, comprising the following stages (a) providing silver bromide or silver bromoiodide nuclei in a colloidal dispersion medium, at a pAg from about 8.5 to about 9.5, a temperature from about 40° C. to about 70° C. and a pH from about 5.0 to about 7.0, (b) precipitating silver bromide or silver bromoiodide on the nuclei, at the same pAg, pH, and temperature as in stage (a) until cores with a mean equivalent spherical diameter (ESD) of between 0.1 and 2.0 μm are obtained;

(c) successively adjusting the pAg to a value between 7.5 and 8.0 and then to a value between 6.0 and 7.5, while maintaining the temperature at approximately 60° C.;

(d) forming a silver bromochloride shell on the cores by double jet addition with a first step of introduction of reactants at an accelerated flow rate and a second step of introduction of reactants at a constant flow rate, while maintaining pAg at a value between 6.0 and 7.5, temperature between 50° and 80° C., and pH between 5.0 and 7.0, during a period of time sufficient for the formation of at least one concave surface laterally surrounded by at least one {100} crystal face.

In another aspect the invention is directed to a photographic silver halide emulsion containing silver halide grains comprised of a silver bromide or bromoiodide core and a silver bromochloride shell surrounding the core, wherein the shell presents at least one {100} crystal face laterally surrounding a concave surface, and from 10 to 90 percent of the projected area of the concave surface and the laterally surrounding {100} crystal face is accounted for by the concave surface.

DETAILED DESCRIPTION OF THE INVENTION

Figure 1:
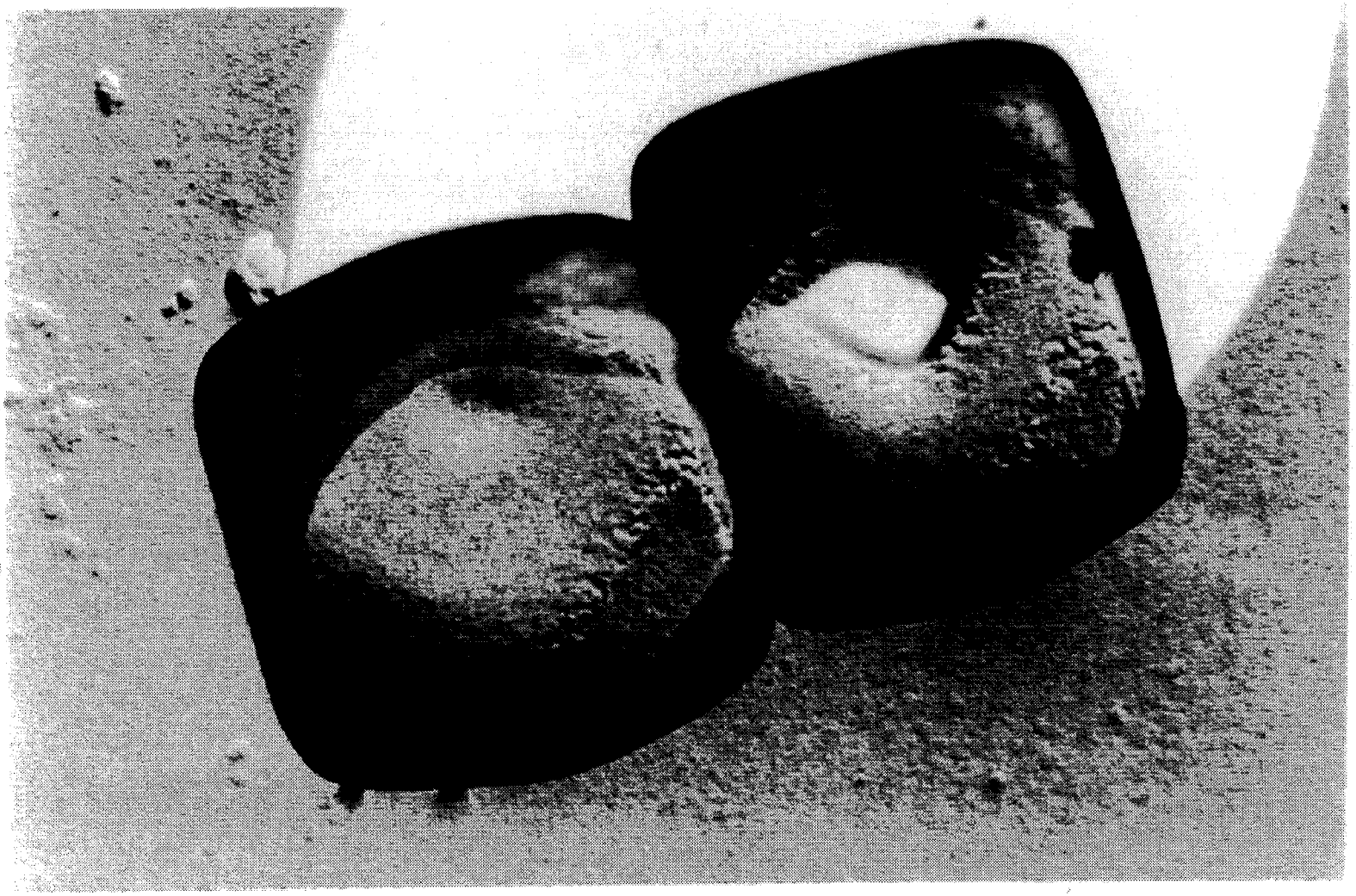
FIG. 1 shows an electron micrograph (150,000 ×magnification) of the carbon replica of two cubo-octahedral grains according to the invention.

In referring to silver halide grains and emulsions containing two or more halides, the halides are named in order of descending concentrations.

The silver halide grains of the invention with cavities on {100} faces have preferably a cubic or cubo-octahedral crystal shape.

The present invention is based on the concept that the morphology of grains can be modified to the point of forming cavities laterally surrounded by {100} faces. It is believed that the cavities thus formed on the {100} faces constitute favored centers for the subsequent deposition or adsorption of substances, for example sensitizing dyes, which can then help to orient the chemical sensitization on favored sites.

The emulsions according to the invention are obtained by precipitating, in a first stage, a first silver halide or halide mixture which constitutes the core of the grains having an octahedral crystal shape, and then, in a second stage, a second silver halide or halide mixture which constitutes the shell of the grains having a cubic or cubo-octahedral crystal shape. It is by modifying the conditions of precipitation of the shell that, under conditions described below, silver bromochloride preferentially deposits on the edges delimiting the {100} faces or on the center of the {111} faces of the grains and that cavities are obtained in the center of the {100} faces of the grains. Consequently, the formation of these cavities laterally surrounded by the {100} faces is also dependent on an appreciable variation in the crystalline phase between the core of the grain and its peripheral part or shell.

The core is comprised of silver bromide or silver bromoiodide. The quantity of iodide may represent up to 30% mole percent and advantageously between 2 and 20% mole percent based on total silver in the core. Preferably, the quantity of iodide is from 2 to 5% mole percent based on total silver in the grain. The presence of iodide in the core of the grain, without being a necessary condition, assists the formation of the cavities in the {100} faces of the shell.

The shell contains silver bromochloride. The chloride content of the shell is between 3 and 70% mole percent based on total silver in the grain. Advantageously, when the core comprises silver bromoiodide, the chloride content of the shell is between 3 and 15% mole percent based on total silver in the grain and when the core is comprised of silver bromide, the chloride content of the shell is comprised between 15 and 70% mole percent based on total silver in the grain.

The shell:core mole ratio in the grains is between approximately 1:1 and 5:1.

The size of the grains, as determined by the equivalent spherical diameter (ESD) is between 0.3 and 5.0 μm. The COV (volume coefficient of variation) is less than 10%. The projected area of the cavity represents from 10 to 90% and preferably 10 to 40% of the combined projected areas of the cavity and the laterally surrounding {100} crystal face. The cavity can be in the form of a squared or rounded hole. The depth of the cavity is at most the thickness of the shell.

As stated above, the present invention has the dual characteristic that the growth of the halide in the shell is modified and a modification of the crystalline phase between the core and the shell is created. This is achieved by modifying the parameters of the precipitation of the shell of the grains, namely the growth profile of the shell, the pAg and the temperature.

In stage (a) silver bromide or silver bromoiodide nuclei are provided, preferably precipitated by double jet introduction of silver nitrate and an alkali halide solution containing bromide or bromide and iodide, into an aqueous solution of gelatin, preferably in the presence of a silver halide solvent, such as a thioether.

In stage (b), the core of the grains comprised of silver bromide or silver bromoiodide is formed, such as by double jet introduction of silver nitrate and of an alkali halide solution containing bromide or bromide and iodide, preferably at accelerated flow rates.

In stage (c) the pAg is adjusted to a value between 7.5 and 8.0 by addition of silver nitrate and to a value between 6.0 and 7.5 while simultaneously effecting further precipitation, such as by the addition of silver nitrate and alkali halide containing bromide and chloride.

In stage (d), in a first step, the flow rates of silver nitrate and alkaline bromochloride are first accelerated, by introducing from 5 to 50 percent of total silver with a rate of introduction increased from 2 to 20 times, for example from 10 to 200 ml/mn from start to finish, and advantageously by introducing from 30 to 40 percent of total silver with a rate of introduction increased from 4 to 10 times, for example from 20 to 100 ml/mn from start to finish. Then in a second step, the flow rates of silver nitrate and alkaline bromochloride are maintained constant, at a value between 50 and 200 ml/mn and advantageously between 70 and 140 ml/min. The temperature is maintained between 50° and 70° C. and preferably between 60° and 70° C.

Figure 2:
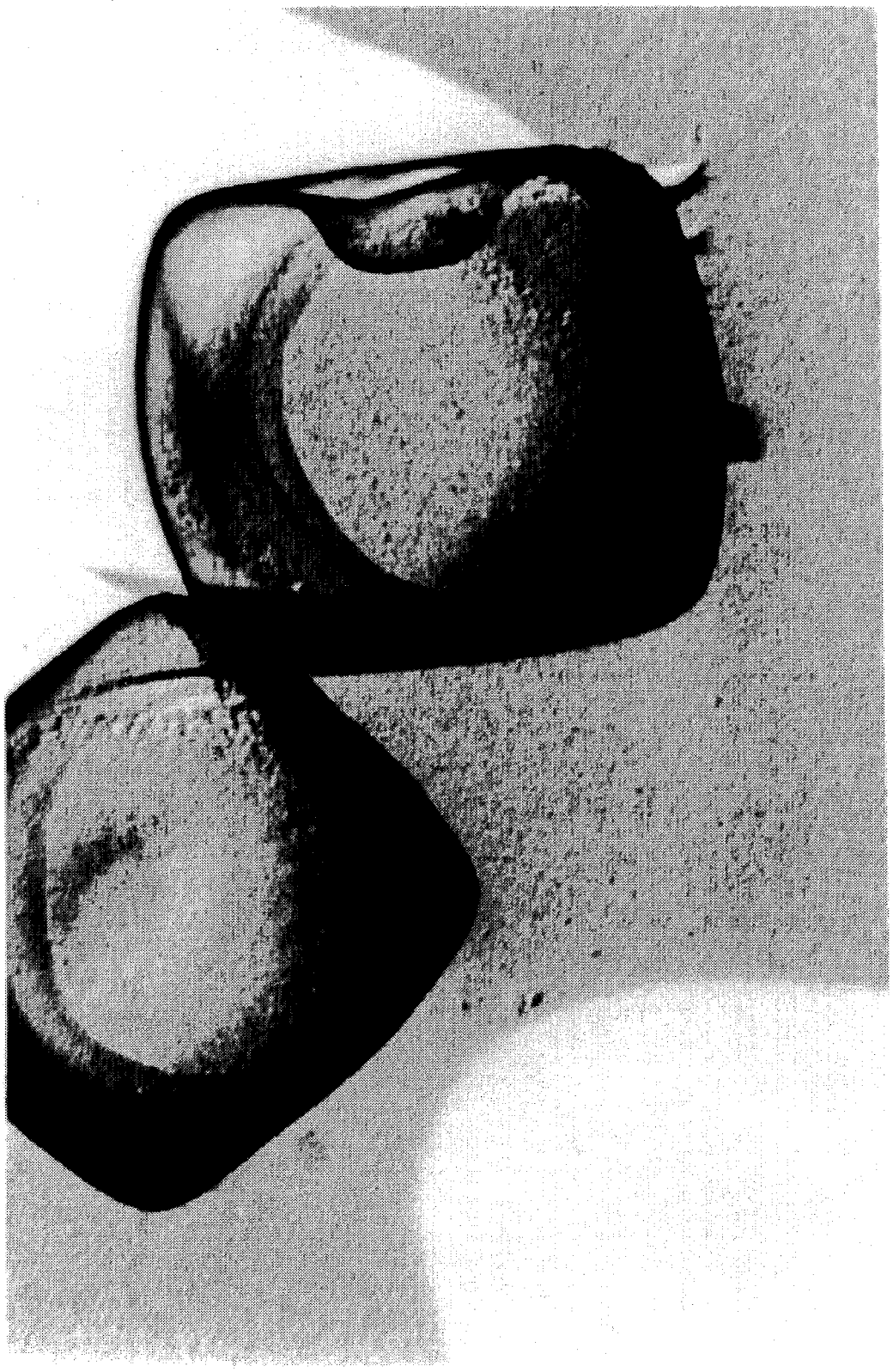
FIG. 2 shows an electron micrograph (150,000 ×magnification) of the carbon replica of two other cubo-octahedral grains according to the invention.

Proof that the silver halide grains according to the invention have cavities laterally surrounded by {100} faces is afforded by:

(A) conventional scanning electron microscopy, by direct microscopic observation, or by observation of carbon replicas. Examples of cubo-octahedral grains according to the invention can be seen in FIG. 1 and FIG. 2. The upper grain in FIG. 1 has an ESD of 1.06 μm with an edge adjacent to the {100} face of 0.54 μm. The cavity has an edge of 0.25 μm and a depth of 0.13 μm; the surface area of the cavity represents 20% of the projected area of the cavity and the surrounding {100} face of the grain.

Figure 3:
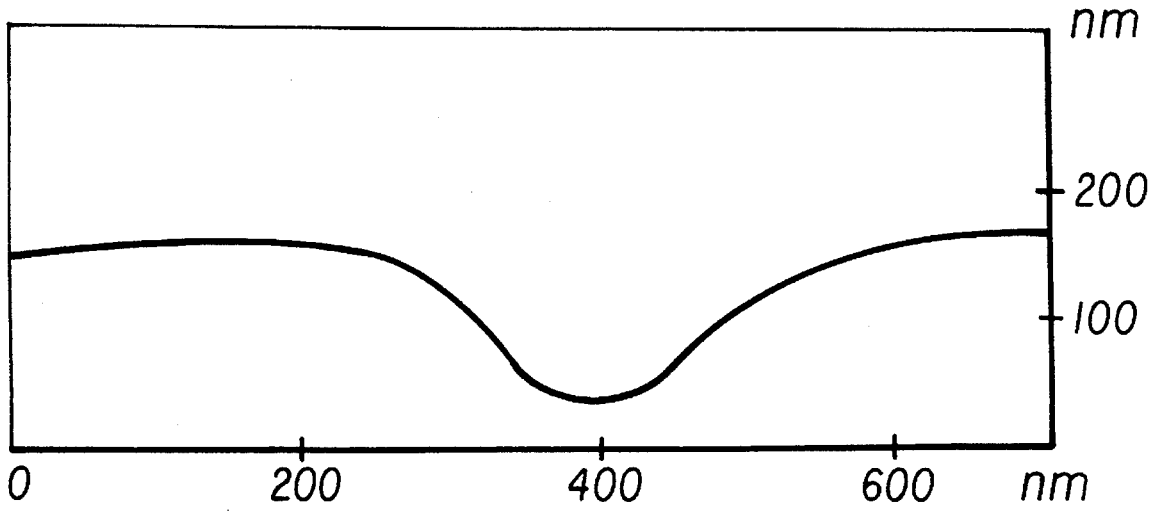
FIG. 3 shows the sectional profile of a {100} face of a silver halide grain according to the invention derived from a Tunnel-effect photomicrograph.

(B) analysis of the surface by tunnel-effect microscopy. FIG. 3 shows the sectional profile derived from a tunnel-effect photomicrograph of a cavity defining {100} face of a silver halide grain according to the invention—i.e., a {100} face laterally surrounding a cavity). The depth of the cavity being 132.7 nm.

A technique for increasing the size of the silver halide crystals formed by the process described here is to carry out the precipitation in the presence of a silver halide solvent. It is preferred that grain growth or ripening occur inside the reactor during grain formation. Known ripening agents can be used. These comprise ammonia or an excess of halide ions. Consequently, it appears that the halide salt solution run into the reactor can itself promote ripening. It is also possible to use other solvents or ripening agents which can be entirely contained within the dispersion medium in the reactor, before silver and halide salt addition or they can be introduced into the reactor with one or more halide or silver salts or peptizers. In another embodiment, the solvent or ripening agent may be introduced independently during the addition of the halide salts and silver salts.

The conventional silver halide solvents suitable for being used in the process of the present invention comprise ammonia, thiocyanates, thiosulphates and various thioethers and thioureas. The solvents based on thioethers comprise the solvents described in U.S. Pat. Nos. 3,271,157, 3,531,289, 3,574,628, 3,767,413, 4,311,638 and 4,725,560. The useful solvents based on thiourea comprise the solvents described in U.S. Pat. Nos. 4,284,717, 4,568,635, 4,695,534, 4,635, 535, 4,713,322 and 4,749,646.

The various modifier compounds, such as for silver halide solvents, ripening agents, spectral sensitizing dyes or doping agents, may be present during the precipitation of the grains. Depending on their properties and selection, they may be absorbed within the cavities in the {100} faces of the grains.

In addition, it is believed that the photographically useful agents, such as developers, development accelerators, development inhibitors, dye image forming couplers, etc., or the precursors of such photographically useful agents, may be present during the precipitation of the grains so as to be incorporated within the cavities in the grain. Such agents are then easily available at the various grain development stages, in accordance with the environment in which they are situated.

The modifier compounds and the photographically useful agents may initially be in the reactor or they may be added either separately or with one or more of the salts, in accordance with conventional operating methods.

The chemical sensitizers and doping agents, such as compounds of copper, thallium, lead, bismuth, cadmium, zinc, the middle chalcogens (namely sulfur, selenium and tellurium), the group VIII noble metals and gold, may be present during the precipitation of the silver halides and are illustrated by U.S. Pat. Nos. 1,195 432, 1,951,933, 2,448, 060, 2,628,167, 2,950,972, 3,488,709, 3,737,313, 3,772,031 and 4,269,927 and *Research Disclosure*, Vol. 134, June 1975, Item 13452. *Research Disclosure* and its predecessor,

*Product Licensing Index*, are publications of Kenneth Mason Publications Limited, Emsworth, Hampshire, PO10 7DD, United Kingdom. The emulsions can be sensitized internally by reduction during precipitation, as described by Moisar et al, *Journal of Photographic Science*, Vol. 25, 1977, pages 19–27.

The halide salts and silver salts individually may be added to the reactor by using surface or sub-surface delivery tubes, by gravity feed or by delivery apparatus for maintaining control of the rate of delivery, the pH, the pBr and/or the pAg of the reaction medium. U.S. Pat. Nos. 3,821,002 and 3,031,304 and Claes et al, Photographische Korrespondenz, Vol. 102, No 10, 1967, page 162, illustrate these methods. In order to obtain a rapid distribution of the reactants in the reactor, special mixing devices can be used. U.S. Pat. Nos. 2,996,287, 3,342,605, 3,415,650, 3,785,777, 4,147,551 and 4,171,224, UK patent application 2,022,431A, German patent applications 2,555,364 and 2,556,885, and *Research Disclosure*, Vol. 166, February 1978, Item 16662, illustrate such methods.

In order to form emulsions, a dispersion medium is initially introduced into the reactor. In a preferred form, the dispersion medium is comprised of an aqueous peptizer suspension. Peptizer concentrations are between approximately 0.2 and 10% by weight, based on the total weight of emulsion components in the reactor. It is usual practice to maintain the concentration of peptizer in the reactor at a value below approximately 6%, based on the total weight, before and during the formation of the silver halide, and to increase the emulsion vehicle concentration in order to obtain optimum coating characteristics by the delayed supplemental addition of vehicle. It will be understood that the emulsion, as initially formed, contains approximately 5 to 50 g of peptizer per mole of silver halide and preferably approximately 10 to 30 g of peptizer per mole of silver halide. An additional quantity of vehicle can be added subsequently in order to obtain a concentration of up to 1000 g per mole of silver halide. The concentration of vehicle in the final emulsion is preferably greater than 50 g per mole of silver halide. When the final emulsion is coated and dried in forming a photographic element, the vehicle preferably represents approximately 30 to 70% by weight of the emulsion layer.

The vehicles (which comprise both binders and peptizers) can be chosen from among the vehicles generally used in silver halide emulsions. The preferred vehicles are hydrophilic colloids, which can be used alone or in combination with hydrophobic substances. Suitable hydrophilic substances comprise gelatin, for example alkali-treated gelatin (hide gelatin or cattle bone gelatin) or acid-treated gelatin (pigskin gelatin), gelatin derivatives, for example acetylated gelatin, phthalylated gelatin, etc.

The vehicles, particularly the hydrophilic colloids, as well as the hydrophobic substances used in combination with the latter, may be employed not only in the layers of emulsion on the photographic elements of this invention, but also in other layers, such as the top layers, the intermediate layers and the layers located below the emulsion layers.

The emulsions are preferably washed in order to eliminate soluble salts. The soluble salts may be eliminated by decantation, filtration and/or chill setting and leaching, as described in U.S. Pat. Nos. 2,316,845 and 3,396,027, by coagulation washing, as described in U.S. Pat. Nos. 2,618,556, 2,614,928, 2,565,418, 3,241,969 and 2,489,341, by centrifugation and decantation of a coagulated emulsion, as described in U.S. Pat. Nos. 2,463,794, 3,707,378, 2,996,287 and 3,498,454, by using hydrocyclones alone or in combination with centrifuges, as described in UK patents 1,336,692 and 1,356,573 and by Ushomirskii et al, *Soviet Chemical Industry*, Vol. 6, No 3, 1974, pages 181–185. The emulsions can be dried and stored, with or without sensitizers, before using them, as described by *Research Disclosure*, Vol. 101, September 1972, Item 10152. It is particularly advantageous to wash the emulsions after the completion of the precipitation.

The silver halide emulsions of the present invention may be sensitized chemically by means of active gelatin, as described by James, *The Theory of The Photographic Process*, 4th Ed., Macmillan, 1977, pp. 67–76, or by means of sulfur, selenium, tellurium, gold, platinum, palladium, iridium, osmium, rhodium, rhenium, or phosphorous sensitizers or combinations or these sensitizers, at pAg levels between 5 and 10, pH values between 5 and 8 and temperatures between 30° and 80° C., as described in *Research Disclosure*, Vol. 120, Apr. 1974, Item 12008, *Research Disclosure*, Vol. 134, June 1975, Item 13452, in U.S. Pat. Nos. 1,623,499 of Sheppard et al, 1,673,522 of Matthies et al, 2,399,083 of Waller et al, 2,642,361 of Damschroder et al, 3,297,447 of McVeigh and 3,297,446 of Dunn, in the UK patent 1,315,755 of McBride, in the U.S. Pat. Nos. 3,772,031 of Berry et al, 3,761,267 of Gilman et al, 3,857,711 of Ohi et al, 3,565,633 of Klinger et al and 3,901,714 and 3,904,415 of Oftedahl, and in the UK patent 1,396,696 of Simons; the chemical sensitization may optionally be conducted in the presence of thiocyanates, as described in the U.S. Pat. No. 2,642,361 of Damschroder, compounds containing sulfur of the type described in the U.S. Pat. No. 2,521,926 of Lowe et al, 3,021,215 of Williams et al and 4,054,457 of Bigelow, or derivatives of carboxylated thiourea as described in U.S. Pat. No. 4,810,626. The emulsions can be sensitized chemically in the presence of modifiers finish (chemical sensitization)—i.e., compounds known to eliminate fogging and increase speed when they are present during the chemical sensitization, such as azaindenes, azapyridazines, azapyrimidines, benzothiazolium salts and sensitizers comprising one or more heterocyclic rings. Examples of agents modifying the finish are described in the U.S. Pat. Nos. 2,131,038 of Brooker et al, 3,411,914 of Dostes, 3,554,757 of Kuwahara et al, 3,565,631 of Oguchi et al and 3,901,714 of Oftadahl, in Canadian patent 778,723 of Walworth and in Duffin, *Photographic Emulsion Chemistry*, Focal Press (1966), New York, pp 138–143. In addition, the emulsions can be sensitized by reduction—e.g., by means of hydrogen, as described in the U.S. Pat. Nos. 3,891,446 of Janusonis and 3,984,249 of Babcock et al, by processing using a low pAg (for example less than 5) and/or a high pH (for example above 8) or by using reducing agents such as tin chloride, thiourea dioxide, polyamines and amineboranes, as described in the U.S. Pat. No. 2,983,601 of Allen et al, in the article by Oftadahl et al, *Research Disclosure*, Vol. 136, August 1975, Item 13654, in U.S. Pat. Nos. 2 518 698 and 2,739,060 of Lowe et al, 2,743,182 and 2,743,183 of Roberts et al, 3,026,203 of Chambers et al and 3,361,564 of Bigelow et al. Surface chemical sensitization or sub-surface sensitization below the surface, such as those described in the U.S. Pat. Nos. 3,917,485 of Morgan and 3,966,476 of Becker can be used. It is also possible to use associations of compounds of gold (I) and carboxylated N-methyl thiourea as described in U.S. Pat. Nos. 5,049,485 and 5,049,484.

The conventional techniques of sensitization by means of noble metals (for example gold), the middle chalcogens (for example sulfur, selenium and/or tellurium) or sensitization by reduction, as well as combinations of these techniques, are described in *Research Disclosure*, Vol. 176, December 1978, Item 17643, paragraph III.

The silver halide emulsions are capable of recording blue exposures. The silver bromide and silver bromoiodide emulsions can be used for recording blue radiation without incorporating blue sensitizers, although their absorption efficiency is much higher when blue sensitizers are used. The silver halide emulsions, regardless of composition, intended to record radiation in the minus blue (green and/or red), are sensitized spectrally to green or red radiation by using spectral sensitizing dyes.

The silver halide emulsions of this invention can be sensitized spectrally by using dyes of various classes, including the class of polymethine dyes, which comprise cyanines, merocyanines, complex cyanines and merocyanines (that is to say tri-, tetra- and polynuclear cyanines and merocyanines), oxonols, hemioxonols, styryls, merostyryls and streptocyanines.

One or more spectral sensitizing dyes can be used. The dyes with the maximum sensitization at wavelengths in the visible spectrum and having a wide variety of spectral sensitivity curve shapes are known. The choice and the relative proportions of the dyes depend on the region of the spectrum which it is desired to sensitize and on the shape of the spectral sensitivity curve desired.

The dyes with overlapping spectral sensitivity curves often yield, in combination, a curve in which the sensitivity at each wavelength in the overlap area is approximately equal to the sum of the sensitivities of the individual dyes. Thus it is possible to use combinations of dyes with different maxima in order to obtain a spectral sensitivity curve with a maximum which is intermediate with respect to the sensitization maxima of the individual dyes.

Combinations of spectral sensitizing dyes can be used which result in supersensitization, that is to say a spectral sensitization greater in a certain spectral region than the one obtained by using any concentration of one of the dyes alone, or which would result from the additive effect of the dyes. Supersensitization can be obtained by using selected combinations of spectral sensitizing dyes and other additives, such as stabilizers and anti-fogging agents, accelerators or development inhibitors, coating additives, optical brighteners and antistatic agents. Gilman, "Review of the Mechanisms of Supersensitization", *Photographic Science and Engineering*, Vol. 18, 1974, pp. 418–430, describes the different mechanisms as well as the compounds which can be responsible for supersensitization.

The spectral sensitization can be implemented at any stage in the preparation of the emulsion which is known up till now for being useful. The most usual spectral sensitization is implemented in the art after ending the chemical sensitization. However, the spectral sensitization can be implemented either simultaneously with the chemical sensitization or before the chemical sensitization; it can even begin before the end of the precipitation of the silver halide grains, as described in U.S. Pat. No. 3,628,960 and in U.S. Pat. No. 4,225,666 of Locker et al. The sensitization can be enhanced by adjusting the pAg, including varying the pAg in one or more cycles, during the chemical and/or spectral sensitization. *Research Disclosure*, Vol. 181, May 1979, Item 18155 gives a specific example of adjustment of the pAg.

The additives, such as spectral sensitizing dyes, in the grains of this invention may be added on all the faces or all the sides of the grains, which makes it possible to obtain a potential increase in the effects derived from these additives.

The sensitization stage, whether it be chemical or spectral, may be implemented before the end of the formation of the grains according to the invention. This procedure allows both internal and external surfaces of the grain to be sensitized thereby providing, which enables a high surface/volume ratio and enhanced light absorption.

The photographic elements can use conventional additives, as described in *Research Disclosure*, Item 17643, cited previously. Optical brighteners can be introduced, as described in paragraph V. Anti-fogging agents and sensitizers can be incorporated, as described in paragraph VI. Absorbent and scattering substances can be used in the emulsions of the invention and in the separate layers of the photographic elements, as described in paragraph VIII. Hardening agents can be incorporated, as described in paragraph X. Coating additives, as described in paragraph XI, and plasticizers and lubricants, as described in paragraph XII, may be present. Antistatic layers, as described in paragraph XIII, may be present. The methods of adding the additives are described in paragraph XIV. Matting agents can be incorporated, as described in paragraph XVI. Developers and development modifying agents can be incorporated, if desired, as described in paragraphs XX and XXI. The silver halide emulsion layers and the intermediate layers, top layers and substrate layers, if any, present in the photographic elements can be coated and dried as described in paragraph XV. Corresponding but updated addenda disclosures can be found in *Research Disclosure*, Vol. 308, December 1989, Item 308119, and Vol. 365, September 1994, Item 36544.

The layers on the photographic elements can be coated on various supports. Conventional photographic supports include polymer films, paper, metal sheets, glass and ceramic supporting elements, provided with one or more subbing layers to reinforce the adhesion properties, the antistatic, dimensional and abrasion properties, the hardness, friction and antihalation characteristics and/or the other properties of the surface of the support. The useful polymer film and paper supports are described in *Research Disclosure*, Article 17643 cited previously, paragraph XVII.

The photographic elements can be used to form dye images in these elements though the selective destruction for formation of dyes. The photographic elements can be used to form dye images by using developers containing dye image forming compounds, such as chromogenic couplers. In this form, the developer contains a color developing agent (for example a primary aromatic amine) which, in its oxidized form, is capable of reacting with the coupler (coupling) to form the image dye.

The dye-forming couplers can be incorporated in the photographic elements, as described in *Research Disclosure*, Vol. 159, July 1977, Article 15930.

The dye-forming couplers and the other photographically useful compounds, such as inhibitors and development accelerators, can be incorporated in the hollow part of the grains of this invention. This can be achieved by adding the compounds to the precipitation vessel before completing the formation of the shell of the grains with the cavities and by eliminating therefrom, by washing, the photographically useful compounds which have not been incorporated, etc. These compounds can be released starting from the central part of the grains in the course of the photographic processing.

The dye-forming couplers are generally chosen to form subtractive primary image dyes (that is to say yellow, magenta and cyan) and they are non-diffusible colorless couplers, such as 2 and 4 equivalent couplers of the open chain ketomethylene, pyrazolone, pyrazolotriazole, pyrazolobenzimidazole, phenol and naphthol type hydrophobically ballasted for incorporation in the high boiling organic (coupler) solvents.

The dye-forming couplers, after coupling, are able to release photographically useful fragments, such as development inhibitors or accelerators, bleaching accelerators, reducing agents, solvents for silver halides, pigments, tanning agents, fogging agents, anti-fogging agents, competing couplers, etc.

EXAMPLE 1

This example illustrates the preparation of photosensitive silver halide grains with cavities on the {100} faces:

a) In a 20 1 reactor, 57.8 g of deionized phthalylated gelatin and 4156 ml of distilled water were added; the solution obtained was heated to 60° C., a thioether was added before adjusting the pH to 5.1 and the pAg to 9.00, using 0.01M NaBr; a 0.5N NaBr solution and a 0.5N $AgNO_3$ solution were added to the reactor by the double-jet technique, maintaining a controlled pAg of 9.00 and with a flow rate of 60 ml/min. In this way a stable population of AgBr microcrystals (0.026 mole) was obtained.

b) The growth of the crystals was continued for 30 minutes under the same conditions, using the double-jet technique with accelerated flow rates with a parabolic profile of $AgNO_3$ (2N), NaBr (1.82N) and KI (0.18N) solutions, as indicated below:

| Duration | Initial flow rate | Final flow rate |
|---|---|---|
| 30 min | 15 ml/min | 114 ml/min |

A mixed AgBrI phase was obtained (precipitation of 3.36 moles of silver).

c) After this growth stage, the pAg was adjusted to 7.75, by introducing 0.25 moles of $AgNO_3$ into the reactor over 148 seconds. The pAg was adjusted to 7.0 by introducing solutions of $AgNO_3$ 2M, NaBr 1.7M and NaCl 0.3M at 25 ml/min over 123 seconds.

d) The crystal growth was continued, using the following flow rate profiles:

| Duration | Solution | Initial flow rate (ml/min) | Final flow rate (ml/min) |
|---|---|---|---|
| (I) 30 min | $AgNO_3$ 2.0M | 20 | 100 |
| | NaBr 1.7M | 23.5 | 117.7 |
| | NaCl 0.3M | 23.5 | 117.7 |
| (II) 15 min | $AgNO_3$ 2.0M | 100 | 100 |
| | NaBr 1.7M | 117.7 | 117.7 |
| | NaCl 0.3M | 117.7 | 117.7 |

The pAg, pH and temperature were maintained at the values recorded at the end of stage (c), namely: pAg 7.0 temperature=60° C., pH =5.10. In phase (I), 3.57 moles of silver was precipitated, and in phase (II) 3.0 moles of silver.

The emulsion was washed in a conventional manner by flocculation.

The final emulsion is comprised of cubo-octahedral grains, more than 90% of the population of grains having at least one {100} face presenting a cavity.

The ESD (Equivalent spherical diameter) of the grains is 1.06 μm; the edge of the {100} face is 0.54 μm; the COV (volume coefficient of variation) is 7.2% and the iodide content is 3 moles % based on total silver in the grain.

The cavity has a squared geometry, the width of the cavity is 0.25 μm; the surface of the cavity is 0.06 μm2; the depth of the cavity is 0.13 μm; the projected area of the cavity represents 20% of the surface area of the {100} face.

EXAMPLE 1A

An emulsion was prepared in accordance with the operating method of Example 1, with the following modifications.

Stage (d) was carried out by using the following flow rates (double jet):

| Duration | Solution | Initial flow rate (ml/min) | Final flow rate (ml/min) |
|---|---|---|---|
| (I) 11.5 min | $AgNO_3$ 2.0M | 20 | 50 |
| | NaBr 1.7M | 23.5 | 58.6 |
| | NaCl 0.3M | 23.5 | 58.6 |
| (II) 57.7 min | $AgNO_3$ 2.0M | 50 | 50 |
| | NaBr 1.7M | 58.6 | 58.6 |
| | NaCl 0.3M | 58.6 | 58.6 |

The emulsion was washed as in Example 1. The final emulsion is comprised of cubo-octahedral grains with an ESD of 1.04 μm, a COV of 7.3% and a total iodide content of 3 moles %. The electron micrographs show that less than 5% of these grains have cavities on their {100} faces.

EXAMPLE 2

The emulsion prepared in accordance with the operating method of Example 1 was sensitized chemically and spectrally in the following manner. After precipitation of the shell and washing, the following were added successively:

Potassium thiocyanate (5H20): 150 mg/mole Ag

Sensitizing dye (I): 186 mg/mole Ag

Sensitizing dye (II): 53.7 mg/mole Ag

After a 10 min stage at 40° C.

Sodium thiosulphate: 0.27 mg/mole Ag $Na_2Au(S_2O_3)_2$: 2.03 mg/mole Ag

After heating at 70° C. for 20 minutes

APMT: 50 mg/mole Ag

Dye (I).

Anhydro-4,5,4',5'-dibenzo-3,3'-bis (3-sulfopropyl)oxacarbocyanine hydroxide, sodium salt

Dye (II)

Anhydro-5-chloro, -9-ethyl-5'-phenyl-3'-(3-sulfobutyl)-3-(3-sulfopropoyl) oxacarbocyanine hydroxide, triethylammonium salt APMT: 1-(acetamido phenyl )-5-mercaptotetrazole The emulsion was applied to a cellulose triacetate support at 8.07 mg/dm$^2$ of silver, 32.3 mg/dm$^2$ of gelatin, 1.75 g/mole Ag of tetraazaindene, and 10.5 mg/dm$^2$ of the dye-forming coupler having the formula:

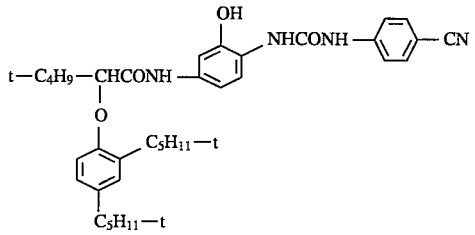

The gelatin was hardened with 1.75% bis(vinylsulfonylmethyl)ether. A top layer of gelatin (21.5 mg/dm$^2$) was coated on this layer. The product thus obtained was exposed for 1/100th of a second to a 3000° K light source through a Wratten 9 filter and processed using the Kodak C-41 process for developing color negative films.

The sensitometric results are set out in Table I.

EXAMPLE 3 (Comparison)

The operating method of Example 2 was repeated, except that the emulsion prepared in Example 1A, the grains of which have practically no cavities, was used. The product was then sensitized, coated, exposed and developed as indicated in Example 2.

The sensitometric results are set out in Table I.

TABLE I

| Example | Dmax | Dmin | Contrast | Relative sensitivity | Δp |
|---|---|---|---|---|---|
| 2 (invention) | 2.04 | 0.13 | 1.33 | 112 | 0 |
| 3 (comparison) | 2.09 | 0.10 | 1.41 | 100 | +7 |

relative sensitivity: calculated at density = 0.3
Δp: loss of sensitivity under the effect of a pressure of 25 psi (175 kPa), exerted before exposure.

EXAMPLE 4

The emulsion prepared in accordance with the operating method of Example 1 was sensitized chemically and spectrally in the following manner. After precipitation of the shell and washing, the following were added successively:

Potassium thiocyanate: 75 mg/mole Ag

Sensitizing dye (I): 186 mg/mole Ag

Sensitizing dye (II): 53.7 mg/mole Ag

After a 10 min stage at 60° C.:

Di(N-methyl-N-carboxymethyl)thiourea: 2.61 mg/mole Ag

Gold (I) bis(1,4,5-trimethyl-1,3,4-triazolium-3-thiolate) tetrafluoroborate 1.8 mg/mole Ag Then heating at 65° C. for 15 minutes.

The emulsion was coated on a support so as to form a product under the same conditions as in Example 2.

The product obtained was processed using the Kodak C-41 process for developing color negative films

EXAMPLE 5 (Comparison)

The operating method of Example 4 was repeated, but using the emulsion prepared in Example 1A, in which the grains have practically no cavities. The product was then sensitized, coated, exposed and processed as in Example 4.

The results obtained are set out in Table II.

TABLE II

| | Dmax | Dmin | Contrast | Relative sensitivity | Δp |
|---|---|---|---|---|---|
| Example 4 (invention) | 2.06 | 0.15 | 1.67 | 142 | +2 |
| Example 5 (comparison) | 1.95 | 0.15 | 1.42 | 136 | +32 |

The invention has been described in detail with particular reference to the preferred embodiments thereof, but it will be understood that variations and modifications can be effected within the spirit and scope of the invention.

What is claimed is:

1. A process for preparing silver halide emulsions containing silver halide grains having {100} crystal faces comprised of a silver bromide or bromoiodide core and a silver bromochloride shell surrounding the core wherein the shell presents at least one {100} crystal face laterally surrounding a concave surface, and from 10 to 90 percent of the projected area of the concave surface and the laterally surrounding {100} crystal face being accounted for by the concave surface, comprising the following stages :

(a) providing silver bromide or silver bromoiodide nuclei in a colloidal dispersion medium, at a pAg from about 8.5 to about 9.5, a temperature from about 40° C. to about 70° C. and a pH from about 5.0 to about 7.0, (b) precipitating silver bromide or silver bromoiodide on the nuclei, at the same pAg, pH, and temperature as in stage (a) until cores with a mean equivalent spherical diameter of between 0.1 and 2.0 μm are obtained;

(c) successively adjusting the pAg to a value between 7.5 and 8.0 and then to a value between 6.0 and 7.5, while maintaining the temperature at approximately 60° C.;

(d) forming a silver bromochloride shell on the cores by double jet addition with a first step of introduction of reactants at an accelerated flow rate and a second step of introduction of reactants at a constant flow rate, while maintaining pAg at a value between 6.0 and 7.5, temperature between 50° and 80° C., and pH between 5.0 and 7.0, during a period of time sufficient for the formation of at least one concave surface surrounded by a {100} crystal face.

2. A process according to claim 1, wherein in (d) the accelerated flow rate is defined by introducing from 5 to 50 percent of total silver with a rate of introduction increased from 2 to 20 times during said first step.

3. A process according to claim 2, wherein in (d) the accelerated flow rate is defined by introducing from 30 to 40 percent of total silver with a rate of introduction increased from 4 to 10 times during said first step.

4. A photographic silver halide emulsion containing silver halide grains comprised of a silver bromide or bromoiodide core and a silver bromochloride shell surrounding the core, wherein the shell presents a {100} crystal face laterally surrounding a concave surface, and from 10 to 90 percent of the projected area of the concave surface and the laterally surrounding {100} crystal face is accounted for by the concave surface.

5. A photographic silver halide emulsion according to claim 4, wherein from 10 to 40 percent of the projected area of the concave surface and the laterally surrounding {100} crystal face is accounted for by the concave surface.

6. A photographic silver halide emulsion according to claim 4, wherein the silver halide grains have an equivalent spherical diameter of from 0.3 to 5.0 μm and a volume coefficient of variation less than 10 percent.

7. A photographic silver halide emulsion according to claim 4, wherein the shell is a silver bromochloride shell containing from 3 to 70% mole percent chloride based on total silver in the grain.

8. A photographic silver halide emulsion according to claim 4, wherein the core is a silver bromoiodide core and the shell is a silver bromochloride shell containing from 3 to 15% mole percent chloride based on total silver in the grain.

9. A photographic silver halide emulsion according to claim 8, wherein the silver bromoiodide core contains between 2 and 5 mole percent iodide and the silver bromochloride shell contains from 3 to 15 mole percent chloride, the mole percentages being based on total silver in the grain.

10. A photographic silver halide emulsion according to claim 4, wherein the core is a silver bromide core and the shell is a silver bromochloride shell containing from 15 to 70% mole percent chloride based on total silver in the grain.

11. A photographic silver halide emulsion according to claim 4, wherein the core is a silver bromoiodide core containing up to 30% mole percent iodide based on total silver in the core.

12. A photographic silver halide emulsion according to claim 4, wherein the shell:core mole ratio in the grains is between approximately 1:1 and 5:1.

13. A photographic product comprising at least one layer of photographic silver halide emulsion according to claim 4.

* * * * *